US011827030B2

(12) United States Patent
Fischer

(10) Patent No.: US 11,827,030 B2
(45) Date of Patent: Nov. 28, 2023

(54) DEVICE FOR PRINTING WITH INK

(71) Applicant: Heidelberger Druckmaschinen AG, Heidelberg (DE)

(72) Inventor: Joerg-Achim Fischer, Laboe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 259 days.

(21) Appl. No.: 17/205,181

(22) Filed: Mar. 18, 2021

(65) Prior Publication Data

US 2021/0291546 A1 Sep. 23, 2021

(30) Foreign Application Priority Data

Mar. 18, 2020 (DE) ..... 102020107415.8

(51) Int. Cl.
*B41J 2/175* (2006.01)

(52) U.S. Cl.
CPC ..... *B41J 2/17596* (2013.01)

(58) Field of Classification Search
CPC ..... B41J 2/18; B41J 2/17596; B41J 2/175
See application file for complete search history.

(56) References Cited

U.S. PATENT DOCUMENTS

| | | | |
|---|---|---|---|
| 6,398,351 | B1 | 6/2002 | Blum et al. |
| 8,408,685 | B2 | 4/2013 | Delueg |
| 9,056,484 | B2 | 6/2015 | Ito et al. |
| 9,327,513 | B2 | 5/2016 | Moriguchi et al. |
| 10,086,623 | B2 * | 10/2018 | Ratjen ..... B41J 2/18 |
| 10,675,885 | B2 | 6/2020 | Mueller et al. |
| 10,987,924 | B2 * | 4/2021 | Fischer ..... B41J 2/04573 |
| 2015/0266306 | A1 | 9/2015 | Sunouchi et al. |
| 2018/0170066 | A1 | 6/2018 | Ohtsu et al. |

FOREIGN PATENT DOCUMENTS

| | | | |
|---|---|---|---|
| AT | 507445 | A2 | 5/2010 |
| CN | 103373066 | A | 10/2013 |
| CN | 105034604 | A | 11/2015 |
| CN | 108215514 | A | 6/2018 |
| CN | 109421381 | A | 3/2019 |
| DE | 69902219 | T2 | 3/2003 |
| JP | 2000318187 | A | 11/2000 |
| WO | 2008080895 | A1 | 7/2008 |

* cited by examiner

*Primary Examiner* — An H Do
(74) *Attorney, Agent, or Firm* — Laurence A. Greenberg; Werner H. Stemer; Ralph E. Locher

(57) ABSTRACT

A device that prints with ink includes an ink reservoir for ink and an arrangement of multiple printing elements, for instance printing heads. The printing elements are identical with one another, they generate ink drops, and they are supplied in parallel with ink from a joint supply line. A further element, which is different from the printing element and which is controllable in terms of its ink flow, for instance a pump, is supplied with ink in parallel with the printing elements by the same supply line. Undesirable hydrostatic pressure changes in the ink are reduced as much as possible, or even eliminated.

20 Claims, 5 Drawing Sheets

DEVICE FOR PRINTING WITH INK

CROSS-REFERENCE TO RELATED APPLICATION

This application claims the priority, under 35 U.S.C. § 119, of German patent application DE 10 2020 107 415.8, filed Mar. 18, 2020; the prior application is herewith incorporated by reference in its entirety.

BACKGROUND OF THE INVENTION

Field of the Invention

The invention relates to a device for printing with ink. The device has a reservoir for the ink and an arrangement of multiple printing elements which are identical with one another, generate ink droplets, and are supplied with ink in parallel by a joint first line.

The technical field of the invention is the field of the graphic industry and in particular the field of industrial, i.e., high-performance inkjet printing on flat substrates, that is, the application of tiny droplets of liquid ink in accordance with an image to sheet-shaped, web-shaped, foil-like, or label-shaped flat printing substrates, preferably made of paper, cardboard, plastic, metal, or a composite material. In particular, the field of the invention is the sub-field of providing a supply of ink, circulating liquid ink to supply printing heads that create the ink droplets, and controlling (particularly closed-loop controlling) the hydrostatic or hydrodynamic liquid ink pressure.

It is known to supply ink to printing heads in industrial inkjet printing machines in a circulating way. An ink supply device in such a machine commonly comprises an ink reservoir, a supply line leading to the printing heads, and a return line leading back to the reservoir.

In a printing operation, undesired fluctuation in the hydrodynamic pressure of the ink may occur since the flow of ink (ink volume per unit of time) is a function of the print image information to be printed, which varies over time. The hydrodynamic pressure in the ink may drop sharply at the beginning of the printing operation for a print (that requires a large amount of ink) and it may rise sharply towards the end. Thus the preset hydrostatic pressure in the ink (referred to as meniscus pressure) may fluctuate in an undesired way.

The hydrostatic pressure may be set by the height arrangement of the components involved and/or by adjusting the circulation pumps involved in the supply and return lines.

Such modifications are undesirable because ink might leak from the printing heads in an uncontrolled way or air might enter the printing heads; both phenomena would mean a considerable deterioration in print quality.

Therefore, undesired hydrodynamic ink pressure fluctuations are to be avoided.

A prior art measure is to install pressure peak dampers in the ink circulation system. Another measure is to counteract fluctuations by controlling (potentially in a closed loop) or feed forward controlling the pumping rate of the circulation pumps. Yet these measures are frequently insufficient because in many cases, the circulation pumps may not be adjusted fast enough.

BRIEF SUMMARY OF THE INVENTION

It is accordingly an object of the invention to provide a printing device which overcomes the above-mentioned disadvantages of the heretofore-known devices and methods of this general type and which provides for an improvement to the prior art and, in particular, provides a way of reducing undesired fluctuations in the hydrostatic pressure of the ink as much as possible or even down to zero.

With the above and other objects in view there is provided, in accordance with the invention, a device for printing with ink, the device comprising:

- a reservoir for ink;
- an arrangement of a plurality of mutually identical printing elements configured to generate ink drops;
- a joint supply line connected to supply said printing elements with ink in parallel; and
- a further element different from said printing elements and controllable in terms of an ink flow thereof, said further element being connected to said supply line to be supplied with ink in parallel with said printing elements.

In other words, the objects of the invention are achieved by a device for printing with ink that comprises an ink reservoir and an arrangement of multiple printing elements that are identical with one another and generate ink drops, and an ink line for jointly supplying the printing elements with ink in parallel. The device according to the invention further includes an element that is different from the printing elements and controllable in terms of ink flow rate (potentially in a closed control loop) and that is supplied with ink in parallel with the printing elements by the ink line.

The invention advantageously provides a way of reducing undesired fluctuations of the hydrostatic pressure in the ink as much as possible or even down to zero.

The invention advantageously makes use of a further element in addition to the printing elements, which may, for instance, be embodied as printing heads. This element is different from the printing elements, e.g. it is not a printing head but a pump; in addition, the element is controlled in terms of ink flow (potentially in a closed control loop), for instance the pumping (ink volume per unit time) may be controlled; and ink is supplied to the element in parallel with the printing elements; for instance, the pump may be connected to the same line or to the same ink manifold in the line.

Undesired (i.e., detrimental) pressure fluctuations or pressure peaks may be avoided or compensated for as much as possible, potentially even down to zero. For this purpose, the element may be controlled (by regulation or in a closed control loop), in particular in a compensatory manner. This controlling (particularly closed-loop controlling) action may advantageously occur in addition to controlling (particularly closed-loop controlling) potential circulation pumps in the ink supply line and/or in the ink return line, i.e., in a potential ink circulation system.

The element may advantageously be designed to be controllable much faster than another pump, for instance a supply line pump or a return line pump. Therefore, the element may be much faster in reducing or compensating for undesired (since detrimental) pressure fluctuations or pressure peaks as much as possible or even down to zero.

The element may advantageously be controlled in an opposite-phase, complementary, and/or compensatory way relative to the printing elements. If the printing elements apply large/small amounts of ink, small/large amounts of ink may flow through the element, for instance if the element is a pump, it may pump small/large amounts of ink. The element may be interpreted as some kind of "dummy" or "phantom" printing element, i.e., as a "dummy" printing head or a "dummy" printing nozzle within a printing head.

The element preferably generates a volume flow (ink volume per unit of time) that is sufficiently quickly adjustable and therefore continuously complementary to the volume flow of the printing element to be compensated for. It preferably provides essentially real-time compensation.

A simple implementation of the invention preferably comprises two large (in terms of pump rate and/or pumping volume) and slow (time constant Tau: 40 to 100 ms) pumps for the supply/return line and a pump for compensation purposes that is small (in terms of pump rate and/or pumping volume) and fast (time constant Tau<10 ms) by comparison. The compensation pump preferably operates at lower rotary speeds (rpm) than the circulation pumps, i.e., it changes its operating point on a lower rpm level whereas the circulation pumps change their operating points on a high rpm level.

The following paragraphs describe preferred further developments of the invention.

A further development may be characterized in that the element is controlled in a way that is complementary to the total ink consumption of the printing elements or to the total ink flow through the printing elements.

Another further development may be characterized in that the element is controlled in a way that is complementary to the total ink consumption of the printing elements in terms of a predefined ink flow.

Another further development may be characterized in that the element is controlled in a way that is complementary to the total ink consumption of the printing elements in terms of a predefined total ink flow.

A further development may be characterized in that the element is controlled in a compensatory way in terms of the total ink consumption of the printing elements or in terms of the total ink flow through the printing elements.

A further development may be characterized in that the device comprises a joint second line and the second line feeds ink that has been fed to the printing elements but has not been used by the latter back to the reservoir.

Another further development may be characterized in that the ink circulates in a system comprising at least the reservoir, the first line, the printing elements, and the second line.

A further development may be characterized in that the printing elements and the element are connected in parallel with one another between the two lines.

Another further development may be characterized in that the printing elements and the element are connected in parallel with one another in such a way that the connecting points for supplying ink to the printing elements succeed one another at the first line and the connecting points for returning ink from the printing elements succeed one another at the second line.

Another further development may be characterized in that the connecting point for the element is disposed downstream of the connecting points of the printing elements in a direction of ink flow.

Another further development may be characterized in that a bypass, i.e. a circumvention line for the ink, is provided between the two lines.

Another further development may be characterized in that the connecting point for the element is connected to the bypass.

A further development may be characterized in that the element is an element different from a printing nozzle, a group of printing nozzles, a one-dimensional row of printing nozzles, a two-dimensional field of printing nozzles, a printing head, a group of printing heads, or a printing bar or in that the element does not generate ink drops.

A further development may be characterized in that the element is a controllable or dynamically controllable pump or micro-pump or an arrangement of multiple such pumps or micro-pumps.

The pump or the micro-pump preferably only generates the compensatory volume flow of ink and not the ink circulation flow. Thus in terms of its pumping rate, the pump or micro-pump may be "smaller" or reduced in comparison to the circulation pumps (supply line pump and/or return line pump).

The pump or micro-pump is preferably integrated close to (with a short line compared to the supply line and/or return line) or even immediately on an ink manifold in the supply line leading to the printing elements.

The pump may be a pushing pump or a suctioning pump (relative to the direction of ink flow in the ink circulation system and/or relative to the connecting point with the ink circulation system).

A further development may be characterized in that the pump or micro-pump is a bidirectional pump.

Another further development may be characterized in that the pump or micro-pump is a peristaltic pump or a gear pump.

A further development may be characterized in that a bypass, i.e. a circumvention line for ink, is provided in parallel with the element.

Another further development may be characterized in that the pump or micro-pump pumps ink back into the reservoir.

Another further development may be characterized in that the pump or micro-pump pumps ink back into the reservoir through a third line.

A further development may be characterized in that the first line comprises a supply line pump and/or the second line comprises a return line pump.

A further development may be characterized in that the supply line pump comprises a supply controller for controlling (particularly closed-loop controlling) the ink volume flow in the supply section and/or in that the return line pump comprises a return controller for controlling (particularly closed-loop controlling) the ink volume flow in the return section.

A further development may be characterized in that the pump or micro-pump is a pump with a maximum pumping rate that is lower than the maximum pumping rate of the supply line pump and/or of the return line pump.

A further development may be characterized in that the pump or micro-pump is a pump with a pumping rate that is adjustable in a faster way than the pumping rate of the supply line pump and/or of the return line pump.

A further development may be characterized in that the pump or micro-pump is a pump with a pumping rate that is controllable in a faster way—in particular in a way that is 50 to 10 times faster or 50 to 100 times faster—than the pumping rate of the supply line pump and/or of the return line pump.

Another further development may be characterized in that the first line comprises a first ink manifold for the printing elements and/or in that the second line comprises a second ink manifold for the pressure elements.

A further development may be characterized in that the first line or the first ink manifold comprises a first ink pressure sensor and/or in that the second line or the second ink manifold comprises a second ink pressure sensor.

A further development may be characterized in that the printing elements are elements of the following list: printing nozzles or at least one group of printing nozzles or at least one one-dimensional row of printing nozzles or at least one two-dimensional field of printing nozzles or printing heads comprising printing nozzles or groups of printing heads comprising printing nozzles or printing bars comprising printing heads.

The element, for instance a pump or micro-pump, may be integrated into a printing bar, for instance virtually like a further printing head.

Implementing the invention with printing nozzles or at least one group of printing nozzles or at least one one-dimensional row of printing nozzles or at least one two-dimensional field of printing nozzles as printing element(s) may be achieved by equipping at least one printing head with printing nozzles in accordance with the invention or with the alternatives indicated above. Such a solution would preferably be implemented by a manufacturer of printing heads. A solution in accordance with the invention using (a) printing element(s) in the form of printing heads comprising printing nozzles or groups of printing heads comprising printing nozzles or printing bars comprising printing heads would preferably be implemented by a manufacturer of machinery for the graphic industry by integrating the printing heads or the alternatives indicated above into the machine.

Using a respective additional printing nozzle (compensation nozzle) as the element in parallel with every printing nozzle may be implemented by actuating the additional printing nozzle with an inverse control signal compared to the associated printing nozzle. This would mean optimum compensation.

If multiple printing nozzles are jointly compensated for, the control signal for the compensation nozzle may be weighted on the basis of the image information to be printed. In addition, this compensation nozzle may be larger than the printing nozzles to be compensated for, i.e., it may emit a larger amount of ink to be able to compensate for the all printing nozzles in total.

A line with a valve that is controllable in a way similar to a printing nozzle may be provided as the compensation element instead of a printing nozzle. The line preferably feeds ink back into the ink circulation system. In this way, the ink used for compensation does not actually have to be jetted.

If larger units such as a group of printing nozzles, at least one one-dimensional row of printing nozzles or at least one two-dimensional field of printing nozzles or printing heads comprising printing nozzles or groups of printing heads comprising printing nozzles or printing bars comprising printing heads are compensated for, the compensation element, for instance a pump, will have correspondingly larger dimensions.

Another further development may be characterized in that the device comprises an ink heater and/or an ink deaerator. Additionally, a filter and/or a device for electrically charging the ink may be provided.

Another further development may be characterized in that the first ink pressure sensor is connected to the supply line controller and/or in that the second ink pressure sensor is connected to the return line controller.

A further development may be characterized in that the device comprises a computer or controller for controlling the element or in that the device is connected to a computer or controller for controlling the element.

Another further development may be characterized in that the first ink pressure sensor and/or the second ink pressure sensor is connected to the computer or controller.

Another further development may be characterized in that the computer or controller controls the supply line pump and/or the return line pump or that the computer or controller is connected to the supply line controller for the supply line pump and/or to the return line controller for the return line pump.

Another further development may be characterized in that a supply line is provided between the pump or micro-pump and the connecting point thereof.

Another further development may be characterized in that the pressure of the ink in the supply line is measured by an ink pressure sensor connected to the computer or controller or by two ink pressure sensors connected to the computer or controller.

A further development may be characterized in that the controlling (particularly closed-loop controlling) is done in such a way that a meniscus pressure of the ink in at least one respective ink outlet of the printing elements corresponds to a predefined value.

Any desired combination of the features and combinations of features disclosed in the above sections on the technical field, invention, and further developments as well as in the section below on exemplary embodiments likewise represents an advantageous further development of the invention. Other features which are considered as characteristic for the invention are set forth in the appended claims.

Although the invention is illustrated and described herein as embodied in a device for printing with ink, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
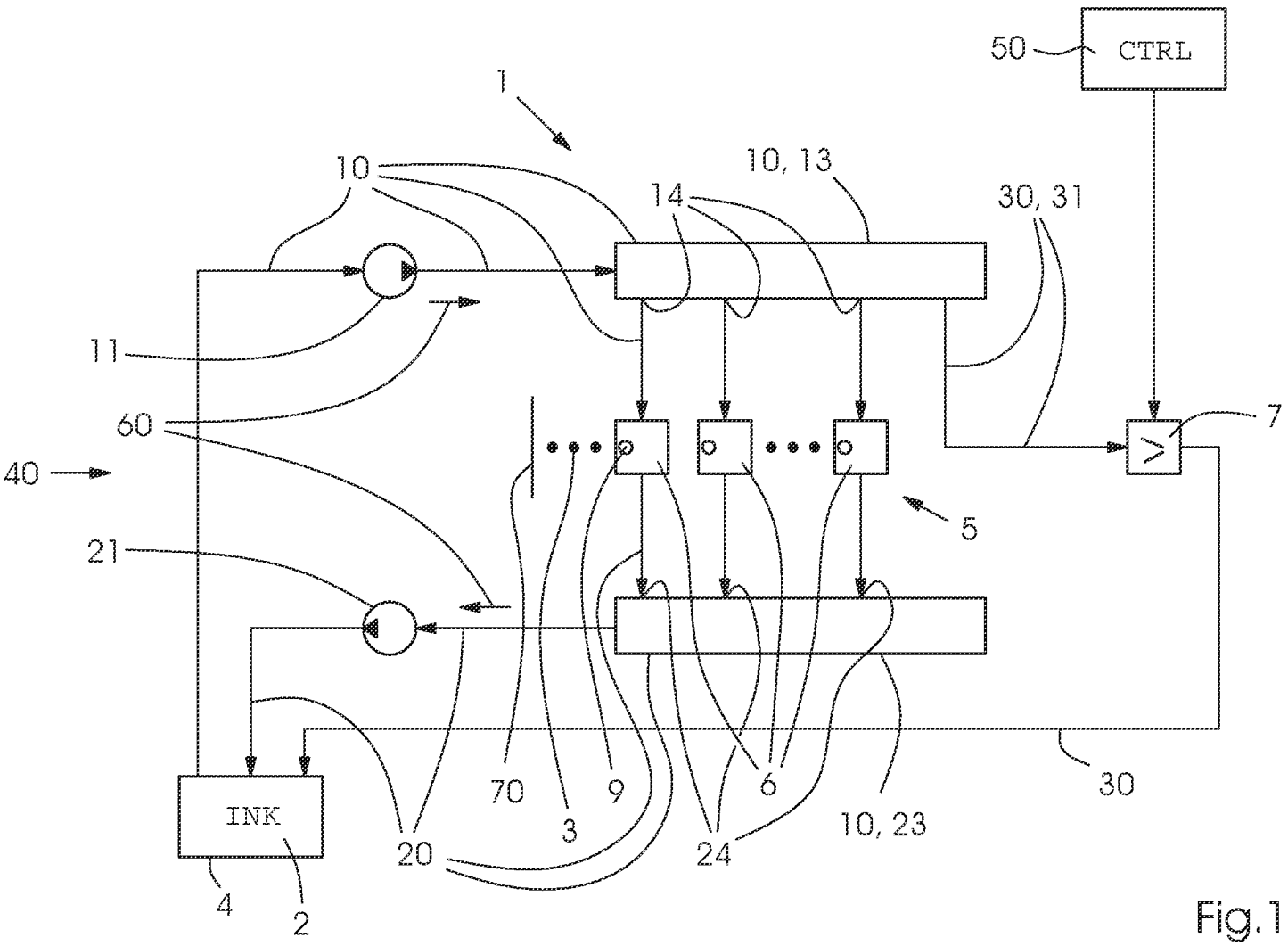
FIG. 1 is a schematic diagram of a preferred exemplary embodiment of a device according to the invention.

Referring now to the figures of the drawing in detail, the figures illustrate preferred exemplary embodiments of the invention and of the further developments. In the figures, corresponding features have the same reference symbols. Repetitive reference symbols have sometimes been left out for reasons of visibility.

With specific reference to FIG. 1, the device 1 of the invention is preferably used to supply ink 2 in an ink printing machine to generate ink drops 3 in accordance with an image to be printed.

The device 1 comprises a reservoir 4 containing the ink 2 and an arrangement 5 of multiple printing elements 6, for instance printing heads 6 in the illustrated example, for jetting the ink drops 3 out of ink outlets 9. The outlets 9 are preferably nozzles that are individually controllable. The printing heads may be disposed in a row, for instance, and may form a printing bar.

The device 1 comprises an element 7. In the illustrated example, it is designed as a pump 7.

The device 1 comprises a first line 10 with a supply line pump 11 for conveying ink 2 from the reservoir 4 to the printing elements 6. The first line 10 comprises a first ink manifold 13 for distributing ink 2 in parallel to the printing elements 6/to the connecting points 14 thereof.

The device 1 comprises a second line 20 with a return line pump 21 for conveying unused ink 2 back from the printing elements 6 to the reservoir 4. The second line 20 comprises a second ink manifold 23 with connecting points 24 for the printing elements 6.

The device 1 comprises a third line 30 with a supply line 31 (or fourth line) to the element 7. The third line is connected to the first line 10, preferably to the ink manifold 13 thereof, and preferably leads back to the reservoir 4. Element 7 is connected in parallel with the printing elements 6 and is thus supplied with ink 2 in parallel with the latter.

Figure 2:
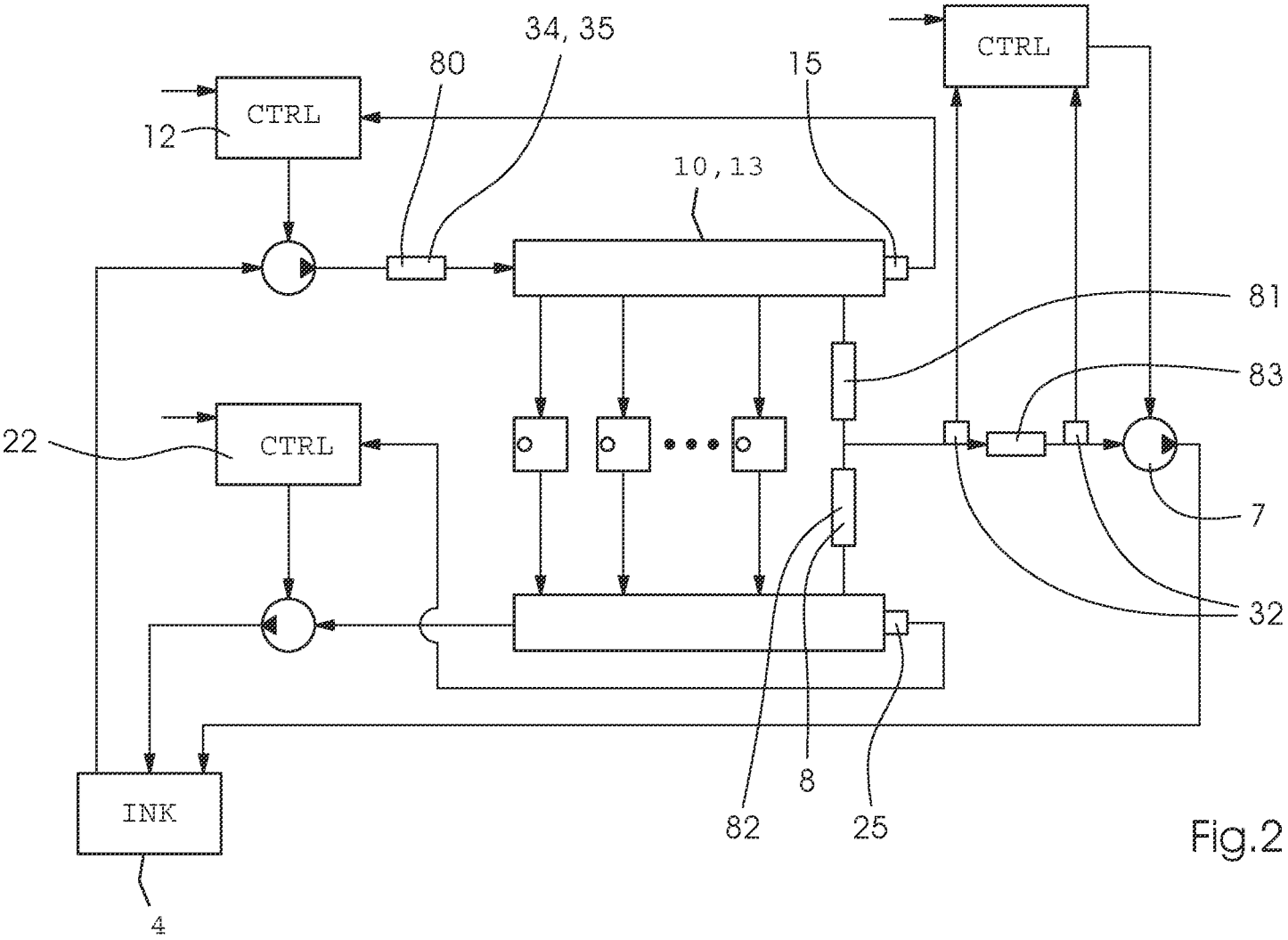
FIG. 2 is a similar diagram illustrating a further exemplary embodiment.
Figure 3:
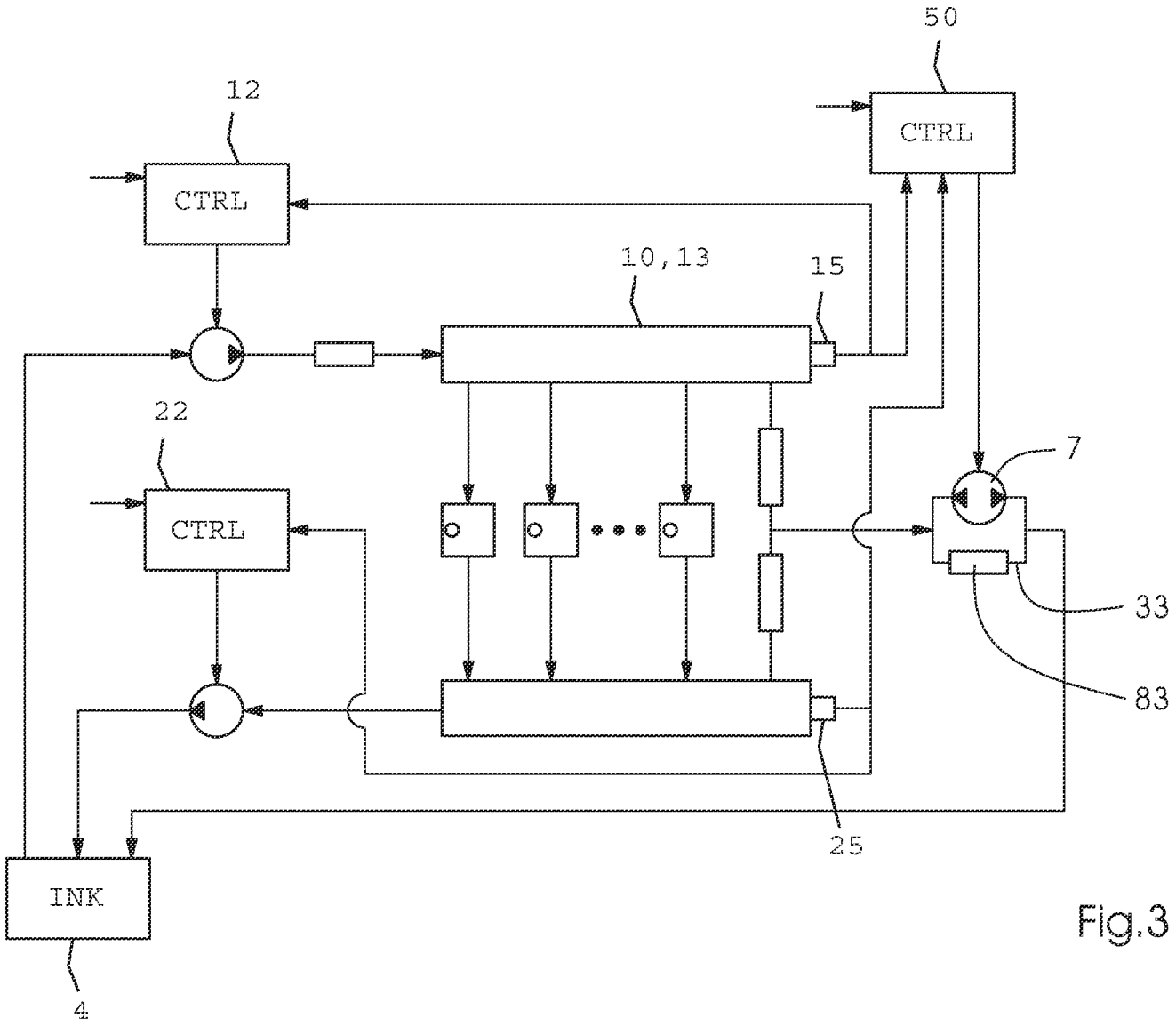
FIG. 3 is a similar diagram illustrating another exemplary embodiment.
Figure 4:
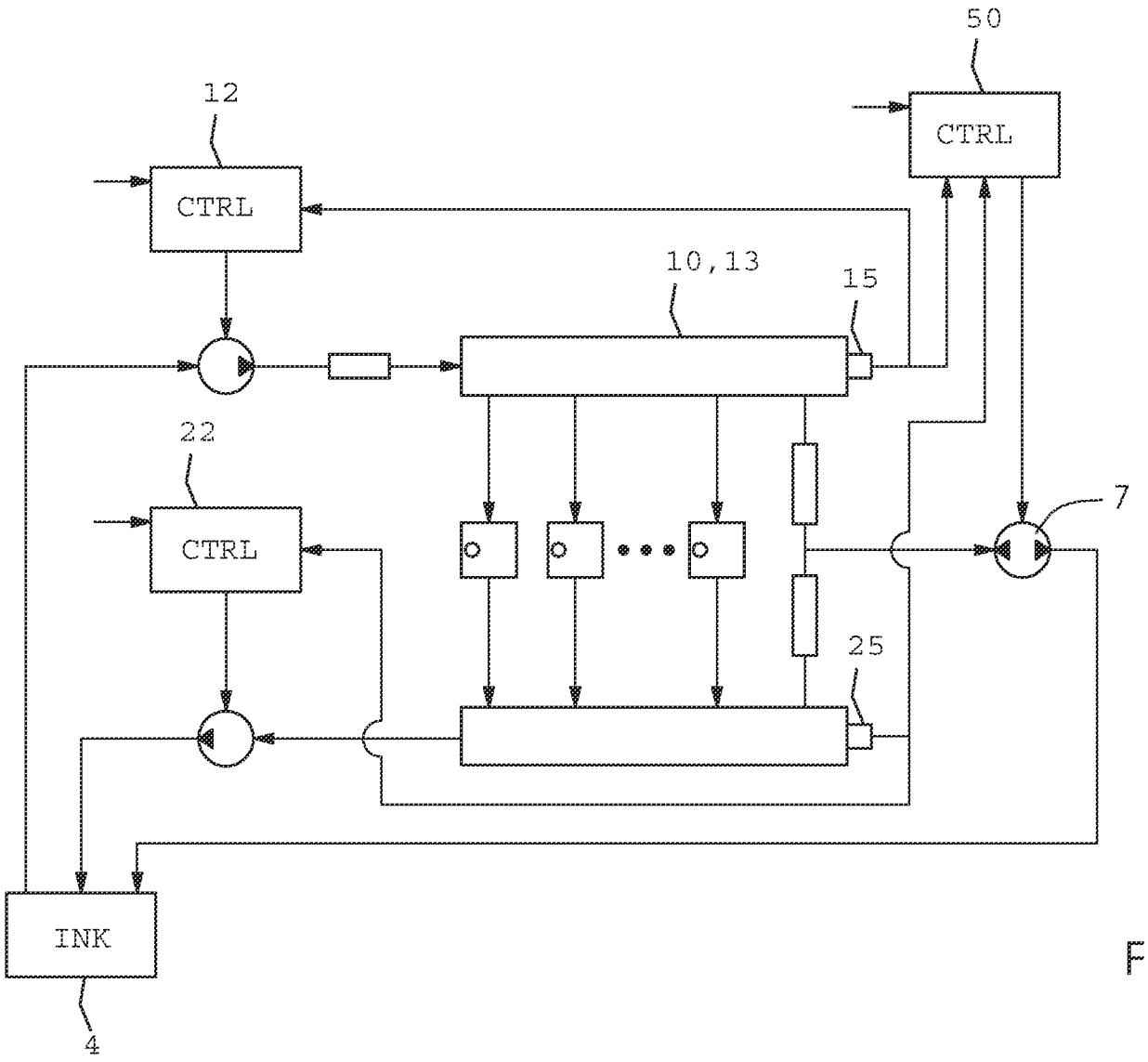
FIG. 4 is a similar diagram illustrating yet a further exemplary embodiment.

The device 1 comprises a (digital) computer 50 for controlling the element 7 such as a pump 7 (potentially in a closed control loop). The further exemplary embodiments shown in FIGS. 2 to 4 provide a more detailed insight into how the element 7 is controlled. In the example shown in FIG. 1, the computer 50 controls the element 7, for instance a pump, in such a way that the ink flow through the element is preferably substantially complementary to the ink flow through the printing elements, i.e. preferably complementary to the total volume of ink that is applied. In other words, if the printing elements apply a large amount of ink, a correspondingly small amount of ink will flow through the element; if the printing elements apply a small amount of ink, a correspondingly large amount of ink will flow through the element. In this process, to avoid undesired pressure peaks or pressure fluctuation in the hydrodynamic pressure of the ink, the complementary ink volume is dimensioned in such a way that the ink volume conveyed by the pumps 11, 21 does not have to be changed or only needs minor changes.

FIG. 1 further illustrates a circulation system 40 comprising at least the reservoir 4, the first line 10, the printing elements 6 and the second line 20; the direction(s) of flow 60 of the ink in the system 40; and a printing substrate 70 to which the ink drops 3 are to be applied to create printed products.

FIG. 2 illustrates a further preferred exemplary embodiment of the device of the invention. The illustrated device 1 comprises all the features shown in FIG. 1 as well as further features that will be described below.

In the first ink line, the device comprises a first ink heater 34, for example, and an ink deaerator 35, for example, as well as further components, for example, such as valves. In the first line 10, these components are jointly indicated as a hydraulic resistance 80.

The device 1 comprises a first pressure sensor 15 and a second pressure sensor 25. The first pressure sensor is preferably disposed on the first ink manifold 13. The second pressure sensor is preferably disposed on the second ink manifold 23.

The device 1 comprises a supply line controller 12 and a return line controller 22. The input of the supply line controller is connected to the first pressure sensor 15, the output to the supply line pump 11. The input of the return line controller is connected to the second pressure sensor 25, the output to the return line pump 21.

The first pressure sensor 15 measures a pressure P_1 and the second pressure sensor 25 measures a pressure P_2. The measured values are forwarded to the controllers 12, 22 as actual values. The supply line controller 12 and the return line controller control (particularly closed-loop control) the pressure in the ink in the ink circulation system. The target values of the controllers are preferably defined in such a way that an acceptable meniscus pressure is reached at the printing elements 6 to prevent the printing elements 6 from leaking ink and to prevent air from entering the printing elements 6.

In this state (when no printing operation is going on), the volume flow of the supplied ink and the volume flow of the returning ink preferably have identical absolute values.

When the printing elements 6 print, ink is withdrawn from the system 40 (in the form of ink drops 3/of a corresponding volume flow). (Without the invention,) the printing volume flow 3 might increase the volume flow in line 10 in a corresponding way and reduce the volume flow in line 20 in a corresponding way.

The figure illustrates examples of further hydraulic resistances 81, 82, and 83. The resistances are intended to represent the respective hydraulic resistances of the lines.

Hydraulic resistances 81 and 82 form a hydraulic ink pressure splitting device that may imitate the meniscus pressure of the printing elements 6. By means of the element 7, a ink volume flow that is preferably complementary to the ink volume flow through the printing elements is generated at the tapping point between the two resistances.

At rest (when no printing operation takes place), the absolute value of the complementary ink volume flow corresponds to the maximum ink volume flow through the printing elements 6. This flow may be measured as a pressure drop at the hydraulic resistance 83 and controlled by means of the element 7. This ink portion preferably gets back into the reservoir 4 through the third line 30.

During a printing operation, the ink volume flow through the printing elements 6 increases. Now without the invention, the meniscus pressure would change in an undesired way. Even small changes may be sensed by the sensors 15 and 25/32. The controller 50 preferably actuates element 7 in such a way that the complementary ink volume flow (ink flow rate) is reduced. In this case, the controller 50 (as a compensation controller) has to control (particularly closed-loop control) two values: the complementary ink volume flow at rest and during a printing operation. The controller is designed in such a way that stabilizing the meniscus takes priority; when the meniscus is stable (zero deviation), the complementary ink volume flow is controlled to the predefined target value (maximum value).

FIG. 3 illustrates a further preferred exemplary embodiment of a device of the invention. The illustrated device 1 comprises all the features shown in FIG. 1 and further features that will be described below.

In practice, this embodiment is preferred over the embodiment of FIG. 2.

The complementary ink volume flow (ink flow rate) is generated as a total by means of the following two components connected in parallel: hydraulic resistance 83 (e.g. a bypass 33 such as an ink line) and bidirectional element 7, e.g. a pump 7 capable of generating a ink volume flow in the one or in the other direction.

The hydraulic resistance 83 is dimensioned in such a way that preferably essentially half of the maximum ink volume flow flows through it.

The element 7 may contribute a positive proportion or a negative proportion of the volume flow. The complementary ink volume flow is thus composed of the flow portions of the two components connected in parallel and their total may assume the value zero or a (predefined) maximum ink volume flow.

The controller 50 uses the measured values 15 measured by the sensors 15 and 25 to calculate the meniscus pressure and controls element 7. If the meniscus pressure deviates, the controller 50 controls element 7 accordingly.

The following is a numerical example:

circulation volume flow (when element 7 and the hydraulic element 83 are inactive)=800 ml/min;

ink volume flow (in total through the printing elements 6)=400 ml/min;

circulation volume flow (when the hydraulic resistance 83 is active)=800 ml/min+200 ml/min=1000 ml/min;

complementary volume flow or ink flow rate (in total when element 7 and the hydraulic resistance 83 are active)=400 ml/min;

complementary volume flow (through the active hydraulic resistance 83)=200 ml/min;

complementary volume flow (through the active element 7)=+200 ml/min when a printing operation takes place and −200 ml/min when no printing operation takes place.

FIG. 4 illustrates a preferred exemplary embodiment of a device of the invention. The illustrated device 1 comprises all the features shown in FIG. 1 and further features that will be described below.

In practice, this embodiment is preferred over the embodiments shown in FIGS. 2 and 3. In practice, the hydraulic resistance 83 (connected in parallel) may be dispensed with and the bidirectional element 7 may be operated without it, i.e. without the hydraulic resistance 83 connected in parallel/without bypass 33.

The controller 50 (as a compensation controller) may process the respective measured values of the two sensors 15 and 25 to obtain an actual value of the meniscus pressure at the printing elements 6. In this process, the controller may in particular factor in the geodetic heights between the ink manifolds 13 and 23 as well as the ink outlets 9 of the printing elements 6.

For instance, the difference between a predefined meniscus pressure target value at the printing elements 6 and the actual value of the meniscus pressure at the printing elements may be fed to the controller 50 (preferably a proportional controller). On the basis of these values, the controller may control (particularly closed-loop control) the ink flow, e.g. the pumping rate of the element 7.

The supply line controller 12 and the return line controller 22 are preferably set in such a way that they likewise control (particularly closed-loop control) the meniscus pressure at the printing elements 6 but significantly more slowly than controller 50. This advantageously turns the technical solution of FIG. 2 or FIG. 3 from a purely complementary compensation of the ink volume flow into a dynamic complementary compensation of the ink volume flow.

In this case the ink volume flow through the printing elements 6 is preferably immediately compensated in real time due to the complementary ink volume flow (ink flow rate) through element 7. The controller 40 with element 7 has a fast reaction time (compared to controllers 12 and 22 with pumps 11 and 21).

The following is a numerical example:

("slow") circulation pumps 11 and 21: time constant Tau=100 ms;

("fast") compensation pump 7: time constant Tau=1 ms;

circulation volume flow (with element 7 inactive)=900 ml/min (15 ml/s);

ink volume flow (total through printing elements 6)=600 ml/min (10 ml/s);

the printing elements apply ink for 10 seconds;

the printing elements do not apply ink for 20 seconds;

complementary ink volume flow or ink flow rate=±300 ml/min (±6 ml/s);

the ink supply system needs approximately 10 to 20 seconds to reach the operating point;

about 60 ml/min flow through the bypass.

Figure 5:
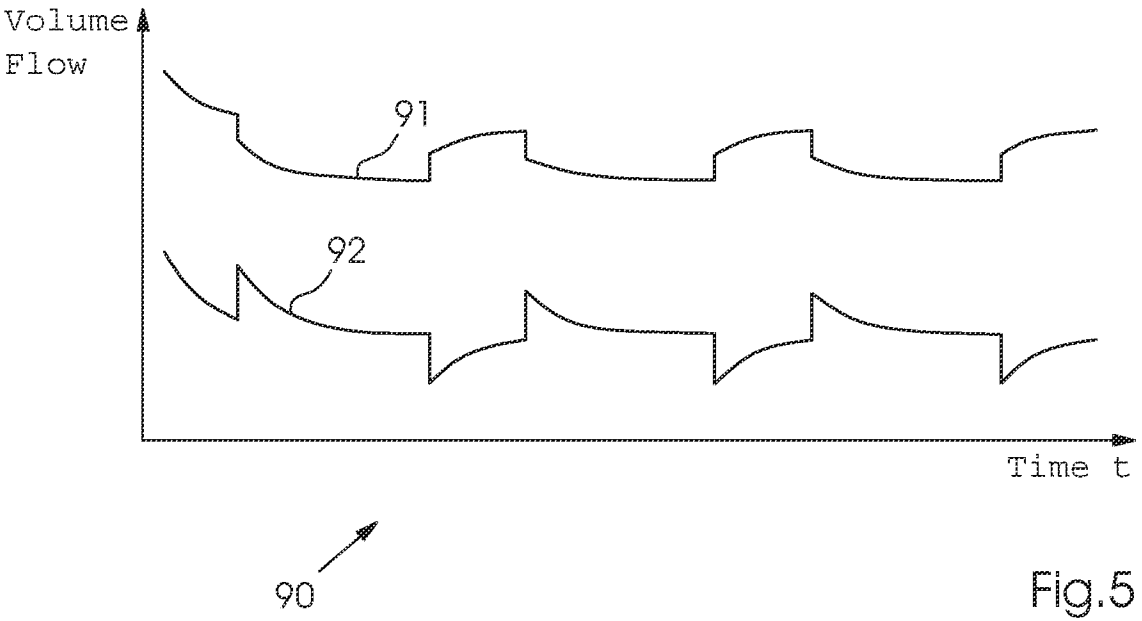
FIG. 5 is a graph illustrating the progression over time of an ink flow volume of a supply and of a compensation volume flow.

FIG. 5 is a diagram 90 illustrates the progression of two curves 91 and 92. The abscissa indicates the time t, for instance in milliseconds (ms), and the ordinate indicates the volume flow, for instance in cubic meters per second ($m^3/s$).

Curve 91 corresponds to the ink volume flow in the first ink manifold 13 (referred to as the supply flow to the printing elements 6); after an initial starting period, it exhibits phases of significant increase, for instance in the period between 30 and 40 ms or between 60 and 70 ms. These periods of time correspond to the phases of printing.

Curve 92 corresponds to the complementary volume flow/ink flow rate (or compensation volume flow) through element 7. This complementary volume flow exhibits a progression over time that ensures that a total of the supply flow and of the compensation volume flow progresses in an essentially constant way.

The following is a summary list of reference numerals and the corresponding structure used in the above description of the invention:

1 device
2 ink/flow rate
3 ink drops
4 reservoir
5 arrangement
6 printing element, e.g. printing head
7 element, e.g. pump
8 bypass
9 ink outlet
10 first line
11 supply line pump
12 supply line controller
13 first ink manifold
14 connecting points
15 first ink pressure sensor
20 second line
21 return line pump
22 return line controller
23 second ink manifold
24 connecting points
25 second ink pressure sensor
30 third line
31 supply line or fourth line
32 ink pressure sensor/ink pressure sensors
33 bypass
34 ink heater
35 ink deaerator
40 system
50 computer or controller
60 direction of flow
70 printing substrate
80-83 hydraulic resistors
90 diagram
91 first curve
92 second curves

The invention claimed is:

1. A device for printing with ink, the device comprising:
a reservoir for ink;
an arrangement of a plurality of mutually identical printing elements configured to generate ink drops;
a joint supply line connected to supply said printing elements with ink in parallel; and
a further element different from and separate from said printing elements and controllable in terms of an ink flow thereof, said further element being connected to said supply line to be supplied with ink in parallel with said printing elements.

2. The device according to claim 1, wherein said further element is controlled complementary to a total ink consumption of said printing elements or to a total ink flow through said printing elements.

3. The device according to claim 2, wherein said further element is closed-loop controlled in compensation for the total ink consumption of said printing elements or in terms of the total ink flow through said printing elements.

4. The device according to claim 1, wherein said supply line is a joint first line and the device further comprises a joint second line, and wherein said joint second line is connected to feed ink which has been fed to the printing elements but not been used back to said reservoir.

5. The device according to claim 4, wherein said printing elements and said further element are connected in parallel between said first and second lines.

6. The device according to claim 4, wherein said first line comprises a supply line pump and/or said second line comprises a return line pump.

7. The device according to claim 6, wherein said supply line pump comprises a supply line controller for controlling an ink volume flow in said supply line and/or said second line is a return line with a return line controller for controlling the ink volume flow in said return line.

8. The device according to claim 4, wherein said first line or a first ink manifold of said first line comprises a first ink pressure sensor and/or said second line or a second ink manifold in said second line comprises a second ink pressure sensor.

9. The device according to claim 1, wherein said further element is an element that is different from an element selected from the group consisting of a printing nozzle, a group of printing nozzles, a one-dimensional row of printing nozzles, a two-dimensional field of printing nozzles, a printing head, a group of printing heads, and a printing bar, or wherein said further element is not configured to generate ink drops.

10. The device according to claim 1, wherein said further element is selected from the group consisting of a controllable or dynamically controllable pump or micro-pump, and an arrangement of multiple controllable or dynamically controllable pumps or micro-pumps.

11. The device according to claim 10, wherein said pump or micro-pump is a bidirectional pump.

12. The device according to claim 10, wherein said first line contains a supply line pump and/or said second line contains a return line pump, and wherein said pump or micropump is a pump having a maximum pumping rate that is lower than a maximum pumping rate of said supply line pump and/or said return line pump.

13. The device according to claim 10, wherein said first line contains a supply line pump and/or said second line contains a return line pump, and wherein said pump or micro-pump is a pump with a pumping rate which is adjustable faster than the pumping rate of the supply line pump and/or of the return line pump.

14. The device according to claim 10, wherein said first line contains a supply line pump and/or said second line contains a return line pump, and wherein the pump or micro-pump is a pump with a pumping rate which is controllable faster than the pumping rate of the supply line pump and/or of the return line pump.

15. The device according to claim 1, further comprising a bypass line for ink connected in parallel with said further element.

16. The device according to claim 1, wherein said printing elements are selected from the group consisting of printing nozzles, at least one group of printing nozzles, at least one one-dimensional row of printing nozzles, at least one two-dimensional field of printing nozzles, printing heads with printing nozzles, groups of printing heads with printing nozzles, and printing bars with printing heads.

17. The device according to claim 1, further comprising a computer or controller or a connection to a computer or controller for controlling said further element.

18. The device according to claim 1, wherein said further element is controlled to be complementary to a total ink consumption of said printing elements or to a total ink flow through said printing elements in order to adjust a meniscus pressure of the ink in at least one respective ink outlet of said printing elements to a predefined value.

19. The device according to claim 1, wherein said further element is configured to be driven in opposite phase to said printing elements in order to compensate for pressure fluctuations in said supply line caused by said printing elements during a printing operation.

20. The device according to claim 19, wherein said further element is configured to act as a phantom printing element not configured to generate ink droplets.

* * * * *